US005579639A

United States Patent [19]

Shimoji et al.

[11] Patent Number: 5,579,639

[45] Date of Patent: Dec. 3, 1996

[54] DOUBLE WALLED EXHAUST PIPE FOR AN ENGINE

[75] Inventors: Koji Shimoji; Minoru Iwata; Kenichi Harada, all of Susono, Japan

[73] Assignee: Toyota Jidosha Kabushiki Kaisha, Toyota, Japan

[21] Appl. No.: 279,727

[22] Filed: Jul. 25, 1994

[30] Foreign Application Priority Data

Jul. 27, 1993 [JP] Japan ..... 5-184587

[51] Int. Cl.[6] ..... F01N 7/08

[52] U.S. Cl. ..... 60/322

[58] Field of Search ..... 60/322

[56] References Cited

U.S. PATENT DOCUMENTS

| | | | |
|---|---|---|---|
| 3,864,909 | 2/1975 | Kern | 60/322 |
| 4,031,700 | 6/1977 | Yamazaki | 60/322 |
| 4,197,704 | 4/1980 | Date | 60/322 |
| 5,331,810 | 7/1994 | Ingermann | 60/322 |

FOREIGN PATENT DOCUMENTS

| | | |
|---|---|---|
| 55-127828 | 9/1980 | Japan . |
| 63-130616 | 8/1988 | Japan . |
| 4-33374 | 4/1992 | Japan . |
| 5-19522 | 3/1993 | Japan . |

*Primary Examiner*—Douglas Hart
*Attorney, Agent, or Firm*—Kenyon & Kenyon

[57] ABSTRACT

The double walled exhaust pipe of the present invention consists of an outer pipe which forms an outer wall of the exhaust pipe and an inner pipe which forms an inner wall of the exhaust pipe, the outer pipe and the inner pipe are fixed each other at an exhaust inlet portion which provides a reference point of the thermal expansion of the inner pipe and the outer pipe. The double walled exhaust pipe of the present invention has at least one bent portion. Further, the inner pipe of the double walled exhaust pipe is divided into longitudinal pipe sections, and at least one sliding connection, which connects the sections of the inner pipe permitting the relative longitudinal slide movements of the pipe sections, is provided between the exhaust inlet portion and the bent portion having the largest bending angle.

5 Claims, 4 Drawing Sheets

DOUBLE WALLED EXHAUST PIPE FOR AN ENGINE

BACKGROUND OF THE INVENTION

1. Field of the Invention

The present invention relates to an exhaust pipe for an engine and, more specifically, the present invention relates to a double walled exhaust pipe having an outer wall and an inner wall.

2. Description of the Related Art

A double walled exhaust pipe is generally used to connect an exhaust manifold of an engine to a catalytic converter in the exhaust system. Catalytic converters can remove the pollutants in the exhaust gas of the engine only when the temperature of the catalyst is high. Therefore, the double walled exhaust pipe is used to keep the exhaust gas temperature high by preventing the heat dissipation through the exhaust pipe wall The double walled exhaust pipe usually composed of two metal pipes arranged coaxially with a radial clearance therebetween. The inner pipe forms the inner wall of the double walled exhaust pipe and the exhaust gas from the engine flows through the inner pipe. The outer pipe forms the outer wall of the double walled exhaust pipe, the air in the radial clearance between the inner and the outer walls acts as a insulating layer to prevent heat dissipating from the exhaust gas in the inner pipe to the atmosphere.

In the double walled exhaust pipe, the temperature of the inner pipe wall becomes high when the engine is in operation since the inner pipe wall contacts the hot exhaust gas directly, while the temperature of the outer pipe wall is kept relatively low.

Due to the difference of the temperatures between the inner pipe and the outer pipe, the amount of the thermal expansion of the inner pipe can be larger than the that of the outer pipe.

To prevent this difference in the amounts of the thermal expansion from causing stress in the exhaust pipe, Japanese Unexamined Utility Model Publication No. 55-127828 discloses a construction of a double walled exhaust pipe which is capable of compensating for the difference in the thermal expansion between the inner and the outer pipes.

The double walled exhaust pipe in the Japanese Unexamined Utility Model Publication No. 55-127828 is provided with an outer pipe which is divided into a plurality of longitudinal pipe sections, and sliding connections which connect the pipe sections of the outer pipe. The sliding connection permits the relative slide movement between the pipe sections along the longitudinal direction while restricting the radial relative movement between the pipe sections. In the double walled exhaust pipe disclosed in the above publication, when the inner pipe expands longitudinally during the operation of the engine, respective sections of the outer pipe can move relatively to each other in accordance with the movement of the inner pipe. Since the sliding connection between the outer pipe sections permits relative longitudinal motion between the outer pipe sections, the difference in the amounts of the thermal expansions of the inner and the outer pipes are absorbed by the relative sliding movements of the outer pipe sections, thus stress is not generated in the elements of the exhaust pipe by the difference in the thermal expansions.

In the double walled exhaust pipe disclosed by the related art, the outer pipe is divided into pipe sections which are connected each other by the sliding connections. However, in the double walled exhaust pipe, usually the outer pipe also acts as a structural support for supporting the weight of the inner pipe as well as that of the outer pipe itself. Therefore, the outer pipe is preferably constructed as one piece for strength, and not divided into sections.

To maintain a one piece construction of the outer pipe, the means for compensating for the difference in thermal expansion must be provided on the inner pipe, instead of on the outer pipe. However, it is more difficult to compensate the expansion of the inner pipe properly since the amount of the thermal expansion of the inner pipe is larger than the amount of the expansion of the outer pipe due to higher temperature of the inner pipe during the operation of the engine.

Further, the outer pipe and the inner pipe must be seal welded to each other at the exhaust gas inlet portion to prevent the exhaust gas from penetrating into the radial clearance between the inner pipe and the outer pipe. Namely, the exhaust gas inlet portion becomes a reference point for the expansion of the inner pipe, and the inner pipe expands from that reference point in the direction of the exhaust gas flow. In such a case, the amount of the movement of the inner pipe due to thermal expansion becomes larger as the distance from the exhaust gas inlet portion increases. When the exhaust pipe has a bent portion at downstream of the exhaust inlet portion, this thermal expansion of the inner pipe may cause the deflection of the inner pipe. If the deflection of the inner pipe becomes larger than the clearance between the inner pipe and the outer pipe, the inner pipe and the outer pipe contact at the bent portion. When the contact between the inner pie and the outer pipe occurs, the thermal expansion of the inner pipe is hindered. This may cause the contact noise between the inner pipe and the outer pipe, and in extreme case, cause an excessive thermal stress in the exhaust pipes.

SUMMARY OF THE INVENTION

In view of the problems set forth above, the object of the present invention is to provide a means for compensating for the thermal expansion of the inner pipe of the double walled exhaust pipe to prevent contact noise and the thermal stress from being generated by the thermal expansion of the inner pipe, especially when the exhaust pipe has a bent portion.

According to the present invention, there is provided a double walled exhaust pipe having an outer wall and an inner wall spaced apart by a radial clearance therebetween. The double walled exhaust pipe comprises an outer pipe, the pipe wall thereof forming the outer wall of the double walled exhaust pipe, and an inner pipe which is coaxially disposed in the outer pipe, the pipe wall thereof forming the inner wall of the double walled exhaust pipe. Also, an exhaust gas inlet portion is disposed at one end of the exhaust pipe and being connected to an engine exhaust manifold, the outer pipe and the inner pipe are fixedly connected each other at the exhaust gas inlet portion, and at least one bent portion is provided in the exhaust pipe. The inner pipe comprises a plurality of longitudinal sections connected each other by at least one sliding connection which allows relative longitudinal movement between the sections, and the sliding connection is disposed at the portion of the inner pipe between the exhaust gas inlet portion and the bent portion having the largest bending angle.

BRIEF DESCRIPTION OF THE DRAWINGS

The present invention will be better understood from the description as set forth hereinafter, with reference to the accompanying drawings, in which.

DESCRIPTION OF THE PREFERRED EMBODIMENTS

Figure 1:
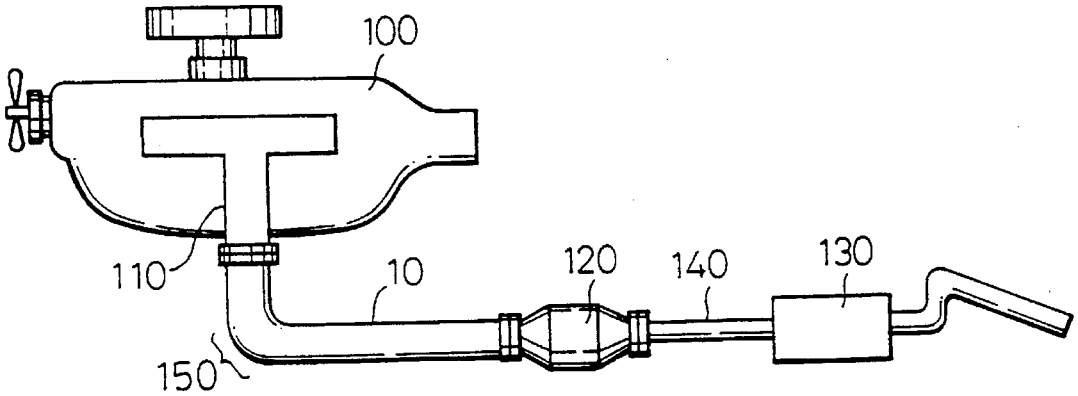
FIG. 1 is a drawing schematically illustrates a typical arrangement of an engine exhaust system to which the double walled exhaust pipe of the present invention is applied.

FIG. 1 schematically illustrates an arrangement of the engine exhaust system having a double walled exhaust pipe according to the present invention.

In FIG. 1, reference numeral 100 represents an internal combustion engine and 110 represents an exhaust manifold of the engine 100. Numeral 10 designates a double walled exhaust pipe which connects the exhaust manifold 110 to a catalytic converter 120. The exhaust gas from the engine flows into the catalytic converter 120 from the exhaust manifold 110 and through the double walled exhaust pipe 10, and after being processed by the catalysts in the converter 120, is discharged to atmosphere through another exhaust pipe 140 which may be a single wall pipe, and a silencer 130.

In this embodiment, the catalytic converter 120 is mounted beneath the floor of the vehicle. Accordingly, the double walled exhaust pipe 10 is provided with an bent portion 15 to connect the exhaust manifold 110 to the catalytic converter 120 disposed at different levels.

Figure 2:
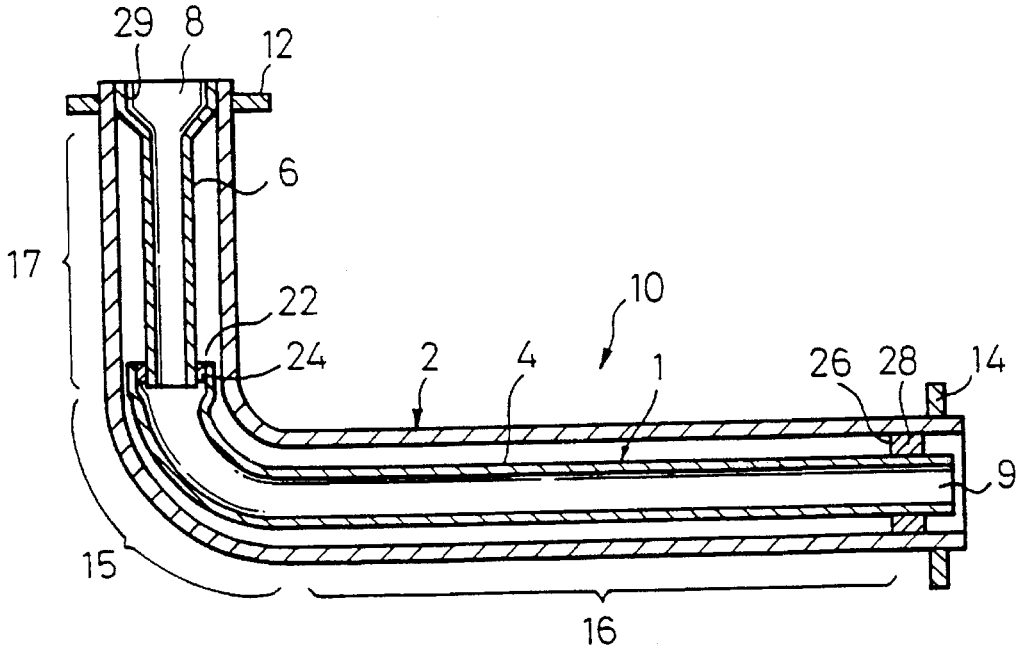
FIG. 2 shows a cross sectional view of an embodiment of the double walled exhaust pipe according to the present invention.

FIG. 2 shows a cross sectional view of the double walled exhaust pipe 10 in FIG. 1. The double walled exhaust pipe 10 comprises an outer pipe 2 and an inner pipe 1 coaxially disposed in the outer pipe 2 in such manner that a radial clearance is formed between the inner pipe 1 and the outer pipe 2. The outer pipe 2 has a one piece construction, i.e., is not divided into sections, and has a larger wall thickness than the inner pipe 1 to provide a rigid support for part of the exhaust system including the inner pipe 1 and the catalytic converter 120.

On the other hand, the inner pipe 1 has a smaller wall thickness to reduce the heat mass thereof, and is divided into to separate pipe sections 4 and 6.

The pipe section 4 consists of a straight portion 16 and a bent portion 15, and the pipe section 6 consists of only a straight portion 17.

Numeral 8 in FIG. 2 shows an exhaust inlet portion of the double walled exhaust pipe 10. At the exhaust inlet portion 8, the double walled exhaust pipe 10 is attached to the exhaust manifold 110 of the engine. Numeral 12 is a flange used to connect the double walled exhaust pipe 10 to a flange (not shown) on the exhaust manifold 110.

To prevent the exhaust gas from the engine flowing into the gap between the inner pipe 1 and outer pipe 2, an expanded diameter portion 29 provided at the inlet portion of the pipe section 6 is attached to the inner surface of the outer pipe by, for example, seal welding. Namely, the pipe section 6 is fixed to the outer pipe 2 at the inlet portion 8.

Numeral 9 in FIG. 2 shows an exhaust outlet portion of the double walled exhaust pipe 10. Numeral 14 is a flange disposed on the outer pipe 2 at the exhaust outlet portion to connect the double walled exhaust pipe 10 to the catalytic converter 120.

A sliding support 26 for the inner pipe 1 is provided at the exhaust outlet portion 9 of the pipe section 4. The sliding support 26 consists of a ring shaped sliding element 28 inserted between the inner pipe 1 and the outer pipe 2 to support the inner pipe 1 radially while permitting the sliding movement of the inner pipe 1 relative to the outer pipe 2. The ring shaped sliding element 28 is made of, for example, a stainless steel wire gauze or a stainless steel wool molded into a ring shape element. The sliding support 26 also acts as a gas seal to prevent the exhaust gas from leaking into the gap between the inner pipe 1 and the outer pipe 2. The pipe section 4 of the inner pipe 1 is supported by the outer pipe 2 via the sliding support 26.

A sliding connection 22 of the pipe sections 4 and 6 is disposed between the bent portion 15 and the exhaust inlet portion 8. At the sliding connection, the free end of the straight pipe section 6 is inserted into the enlarged end portion of the pipe section 4, and the ring shaped sliding element 24, similar to the element 28 is inserted in the radial gap between the pipe sections 4 and 6. The ring shaped sliding element 24 permits the relative longitudinal sliding movement between the pipe sections 4 and 6 while restricting the radial movement between the pipe sections 4 and 6. The sliding element 24 also act as a gas seal to prevent the exhaust gas from leaking into the radial gap between the inner pipe 1 and outer pipe 2. Namely, when the hot exhaust gas flows through the inner pipe 1, the pipe section 6 expands downward direction in FIG. 2, since the inlet portion of the pipe section 6 is fixed to the outer pipe 2. When the pipe section 6 expands, the end portion of the pipe section 6 slides into the pipe section 4. Thus the expansion of the straight pipe section 6 is absorbed by the sliding connection 22 without pushing the pipe section 4 downward.

Numeral 22 in FIG. 2 designates a sliding connection between the pipe sections 4 and 6 of the inner pipe 1. The sliding connection 22 is disposed at the straight pipe portion between the bent portion 15 and the exhaust gas inlet portion 8. In the sliding connection 22, the free end of the straight pipe section 6 is inserted into the enlarged end portion of the pipe section 4, and the ring shaped sliding element 24, similar to the element 28 is inserted in the radial gap between the pipe sections 4 and 6. The ring shaped sliding element 24 permits the relative longitudinal sliding movement between the pipe sections 4 and 6 while restricting the radial movement between the pipe sections 4 and 6. The sliding element 24 also act as a gas seal to prevent the exhaust gas from leaking into the radial gap between the inner pipe 1 and outer pipe 2.

The reason why the sliding connection 22 is located on the portion between the exhaust gas inlet 8 and the bent portion 15 is explained.

When the engine is in operation, the hot exhaust gas flows into the inner pipe 1 from the exhaust inlet portion 8 and flows through the inner pipe 1 to the exhaust outlet portion 9. The temperature of the exhaust gas becomes lower as the exhaust gas flows down through the inner pipe 1 due to the heat dissipation through the wall of the inner pipe 1. Therefore, the wall temperature of the inner pipe 1 is highest in the pipe section 6 which is directly connected to the exhaust manifold of the engine.

Figure 3:
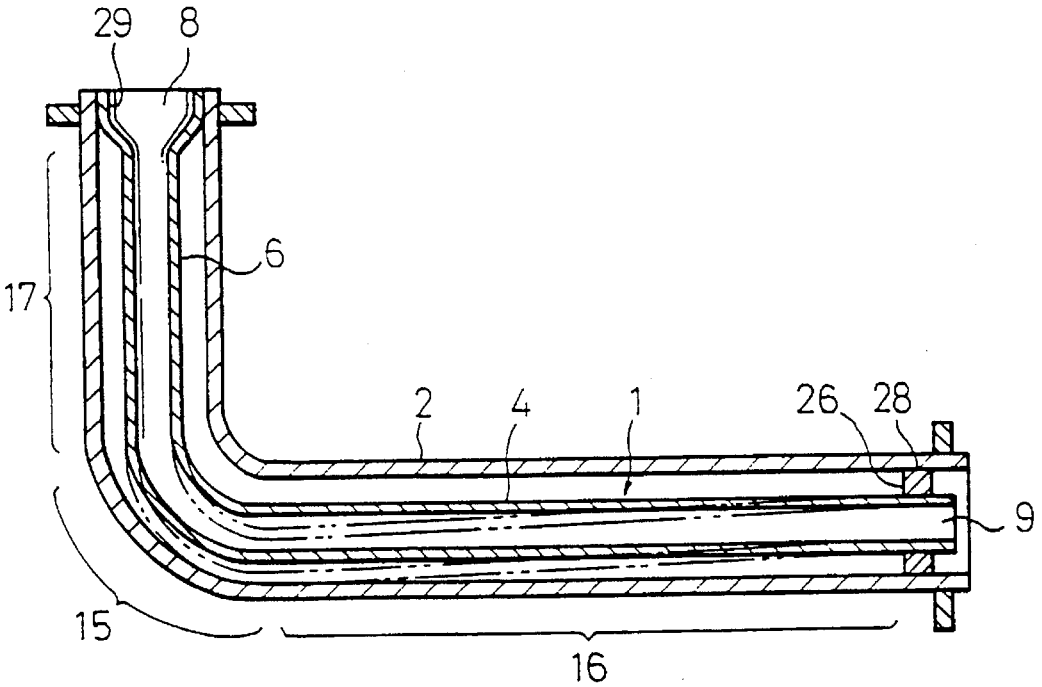
FIG. 3 is a drawing explaining the effect of the thermal expansion of the inner pipe of the double walled exhaust pipe.

This means that the amount of the thermal expansion in the pipe section 6 becomes much larger than in the pipe section 4. Further, the pipe section 6 is fixed to the outer pipe 2 at the inlet portion 8. Therefore, the pipe section 6 expands only in the direction towards the bent portion 15. If the sliding connection 22 were not provided between the pipe sections 4 and 6, this thermal expansion of the pipe section 6 pushes the pipe section 4 downward. This causes the pipe section 6 to be deflect as shown by the dotted line in FIG. 3 and cause the inner pipe section 4 to contact the outer pipe 1 at the portion near the bent portion 15.

However, since the sliding connection 22 is provided in this embodiment, the end portion of the pipe section 6 slides into the pipe section 4 when the pipe section 6 expands, and the expansion of the straight pipe section 6 is absorbed by the sliding connection 22 without pushing the pipe section 4 downward.

To prevent the inner pipe 1 from contacting the outer pipe 2, the sliding connection 22 must be located between the bent portion 15 and the exhaust inlet portion 8 of the double walled exhaust pipe 10, because the amount of the thermal expansion of the pipe section 6 is largest, and this entire expansion of the pipe section 6 must be absorbed by the sliding connection 22 without exerting any stress on the pipe section 4.

Figure 4:
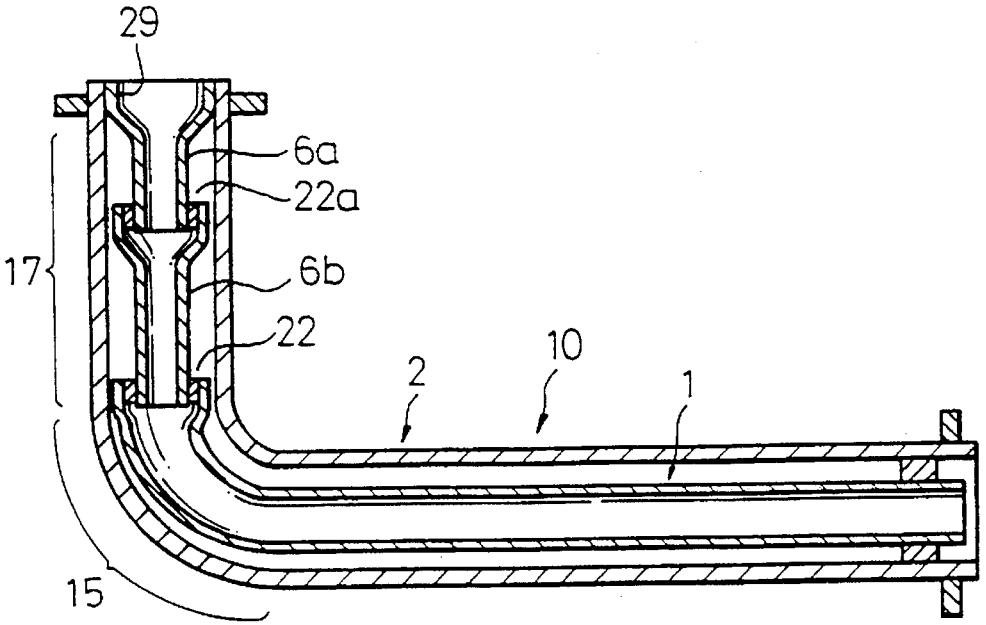
FIG. 4 shows a cross sectional view of another embodiment of the double walled exhaust pipe according to the present invention.

In the embodiment in FIG. 2, the horizontal pipe section 4 also expands during the operation of the engine although the amount thereof is much smaller than the same of the pipe section 6. Since the sliding support 26 is provided on the inner pipe section 4 at the exhaust outlet portion 9, this thermal expansion of the pipe section 4 is absorbed by the sliding motion of the pipe section 4 at the sliding support 26. Thus, according to the present invention, the inner pipe 1 becomes completely free from the stress caused by the thermal expansion FIG. 4 shows another embodiment of the double walled exhaust pipe according to the present invention. In this embodiment, the construction of the double walled exhaust pipe 10 is essentially the same as the construction shown in FIG. 2. However, the pipe section 6 in FIG. 2 is further divided into two sections 6*a* and 6*b* in this embodiment, and a sliding connection 22*a* which is similar to the sliding connection 22 is provided between the pipe sections 6*a* and 6*b* in addition to the sliding connection 22 in FIG. 2. Since two sliding connections 22 and 22*a* are provided on the portion between the exhaust inlet portion 8 and the bent portion 15, the capacity for absorbing the thermal expansion is also substantially doubled in this embodiment. This arrangement is especially suitable when the difference in the amount of the thermal expansion, between the inner pipe 1 and the outer pipe 2, is large at the portion between the exhaust inlet portion 8 and the bent portion 15.

Figure 5:
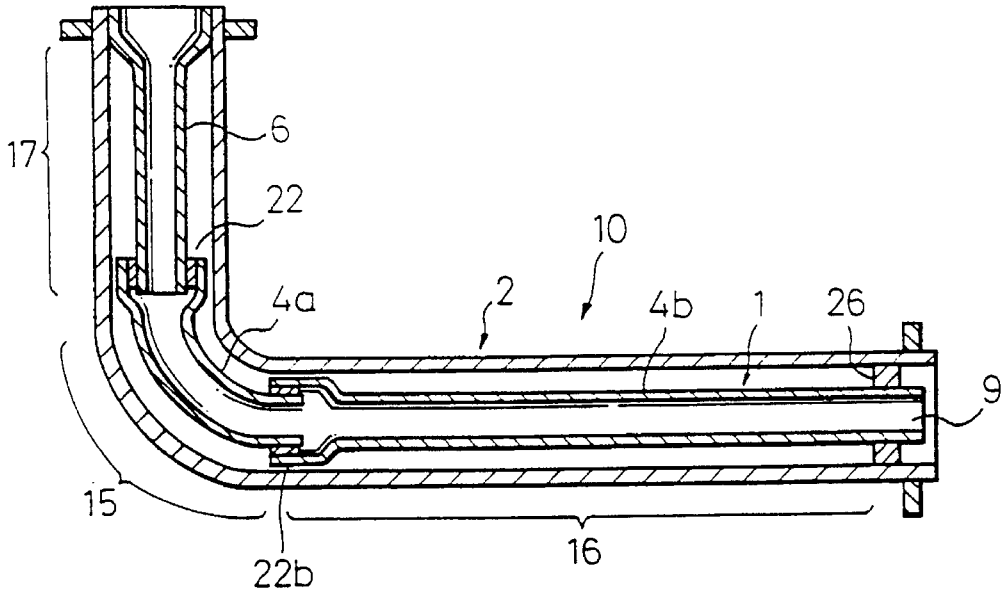
FIG. 5 shows a cross sectional view of another embodiment of the double walled exhaust pipe according to the present invention.

FIG. 5 shows another embodiment of the double walled exhaust pipe according to the present invention. In this embodiment, the pipe section 4 in FIG. 2, instead of pipe section 6, is further divided into two pipe sections 4*a* and 4*b*. The pipe section 4*a* is only consists of the bent portion of the pipe section 4 in FIG. 2, and the pipe section 4*b* consists of the straight portion of the pipe section 4 in FIG. 2. Further, a sliding connection 22*b* is provided between the pipe sections 4*a* and 4*b*, in addition to the sliding connection 22 in FIG. 2.

In this embodiment, the difference in the thermal expansion between the inner pipe 1 and outer pipe 2 of the straight portion 17 is absorbed by the relative movement of the pipe sections 4*a* and 4*b* at the sliding connection 22*b*, as well as by the relative movement of the pipe section 4*b* and the outer pipe 2 at the sliding support 26.

Figure 6:
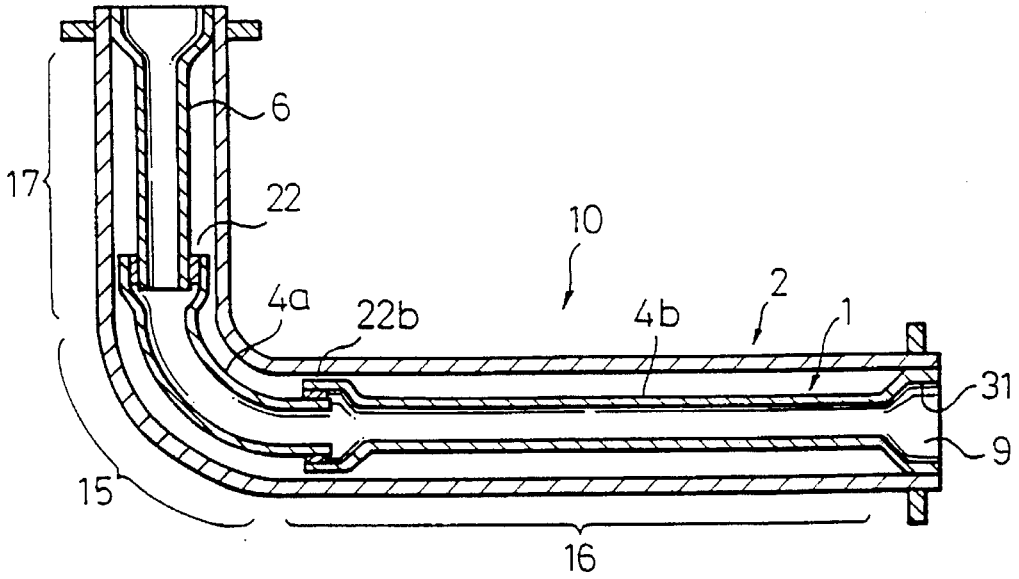
FIG. 6 shows a cross sectional view of another embodiment of the double walled exhaust pipe according to the present invention.

FIG. 6 shows an example of a modification of the embodiment in FIG. 5. In this embodiment, the sliding support 26 in FIG. 5 is not provided and the pipe section 4*b* of the inner pipe 1 is fixed to the outer pipe 2 at the exhaust gas outlet portion 9 in the same manner as the exhaust gas inlet portion 8. In this embodiment, all of the thermal expansion of the pipe section 4*b* is absorbed by the sliding connection 22*b*. Since the inner pipe 2 and the outer pipe 1 are seal welded at both the inlet portion 8 and the outlet portion 9, the penetration of the exhaust gas into the clearance between the inner pipe 1 and the outer pipe 2 is completely prevented.

Note that, at the sliding connections in all of the above embodiments, the end portions of the pipe sections located upstream (for example, the pipe section 6 in FIG. 2) are inserted into the enlarged end portions of the pipe sections located downstream (for example, the pipe section 4 in FIG. 2). This feature is preferred to prevent the exhaust gas flowing through the sliding connections 22 from leaking into the radial clearance between the inner pipe 1 and the outer pipe 2 through the ring shaped sliding elements.

Next, the embodiment in which the double walled exhaust pipe of the present invention is applied to the engine having more than one exhaust manifold is explained with reference to FIGS. 7 and 8.

Figure 7:
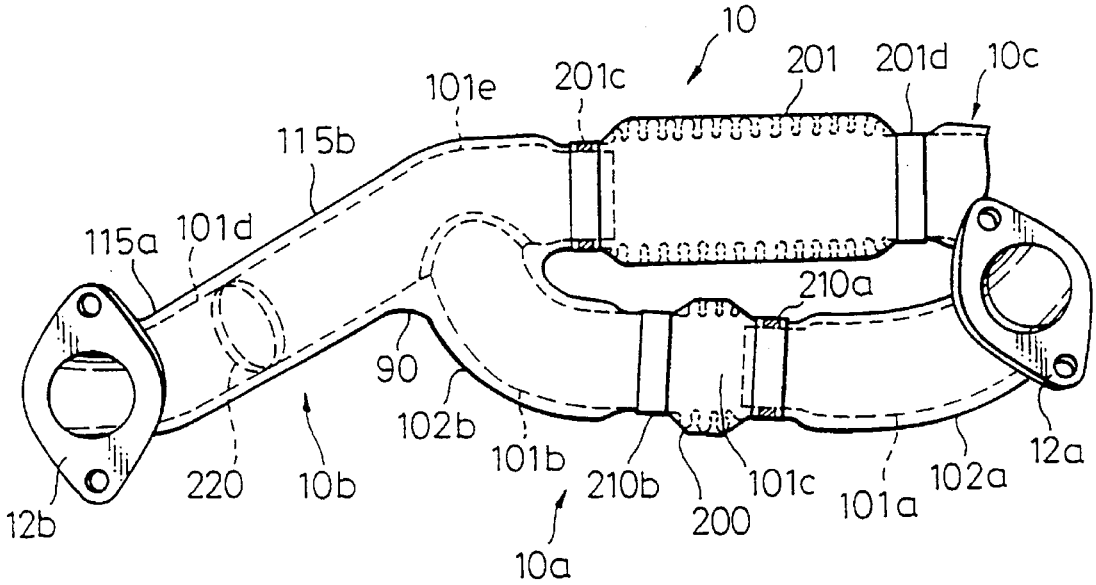
FIG. 7 is a plan view of an embodiment of the double walled exhaust pipe according to the present invention applied to V-type or horizontally opposed type engines; and, FIG. 8 is an elevation view of the double walled exhaust pipe in FIG. 7.
Figure 8:
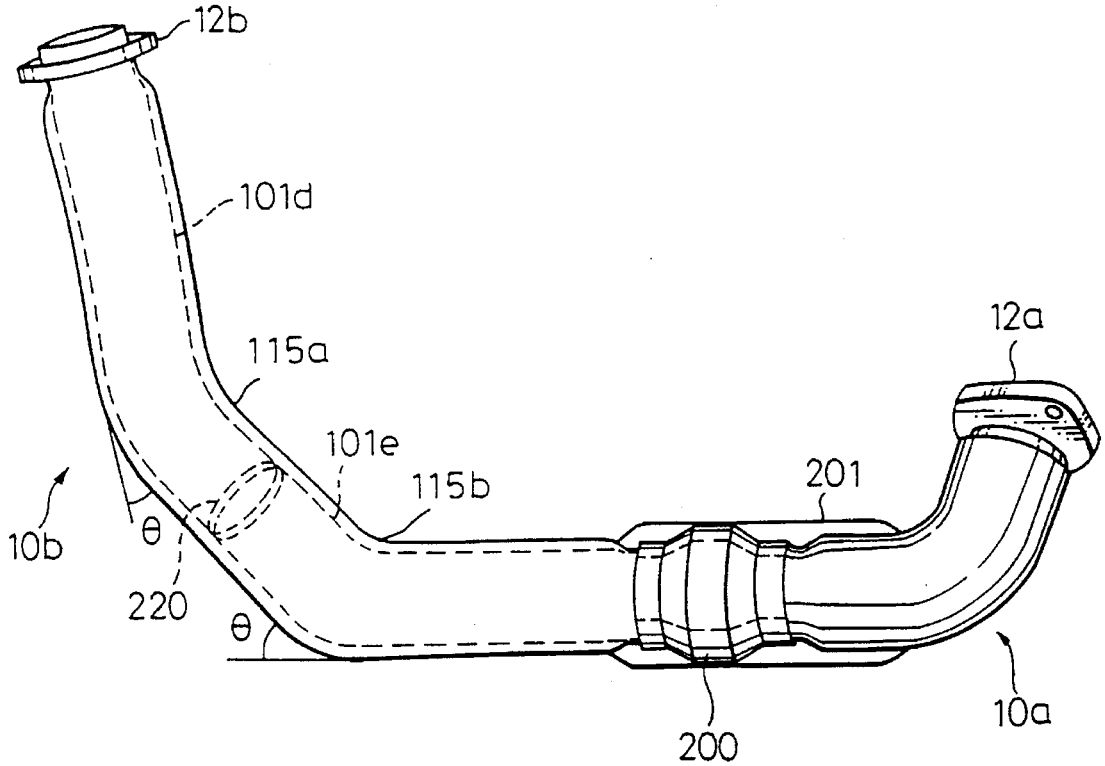

FIGS. 7 and 8 show a plan view and an elevation view of the double walled exhaust pipe 10 respectively. The double walled exhaust pipe in FIGS. 7 and 8 is applied to V-type or horizontally opposed type engines having more than one exhaust manifold. The configuration of the exhaust pipe 10 in this embodiment is more complicated than the preceding embodiments, since two separate exhaust manifolds are connected to one catalytic converter by this exhaust pipe.

In FIGS. 7 and 8, numerals 12*a* and 12*b* are exhaust inlet flanges which are connected to separate exhaust manifolds of the engine (not illustrated). Connected to the inlet flanges 12*a* and 12*b* are branch exhaust pipes 10*a* and 10*b*. The branch pipe 10*a* merges to the branch pipe 10*b* at the merging point 90 of the branch pipe 10*b*.

In this embodiment, the branch exhaust pipes 10*a* and 10*b* are double walled construction having inner pipes and outer pipes. In the branch exhaust pipe 10*a*, the inner pipe is divided into two pipe sections 101*a* and 101*b* which are disposed longitudinal space 101*c* therebetween. The outer pipe 102 of the branch 10*a* is also divided into to pipe sections 102*a* and 102*b*. The pipe sections 102*a* and 102*b* are connected by a bellows 200.

Also the pipe section 101*a* of the inner pipe and the pipe section 102*a* of the outer pipe are seal welded to each other at the inlet flange 12*a*. At the inlet of the bellows 200, sliding supports 210*a* which is similar construction as the sliding support 26 in FIG. 2 is provided between the inner pipe section 101*a* and the outer pipe section 102*a*. At the outlet of the bellows 200, the inner pipe section 101*b* and 102*b* are seal welded to each other.

The branch pipe 10*b* has two bent portions 115*a* and 115*b* as shown in FIG. 8. The upstream bent portion 115*a* has a smaller bending angle (indicated by θ in FIG. 8) than the downstream bent portion 115*b*, and at downstream of the bent portion 115*b*, and the inner pipe section 101*b* and the outer pipe section 102*b* are welded to the inner pipe section 101*e* and the outer pipe section 102*c*, respectively at the merging point 90 located downstream of the bent portion 115*b*.

The branch exhaust pipe 10*b* is connected to bellows 201 at the portion downstream of the merging point 90, and another double walled exhaust pipe 10*c* is connected to the bellows to lead the exhaust gas to a catalytic converter (not shown). The inner pipe of the branch exhaust pipe 10*b* is divided into two pipe sections 101*d* and 101*e*. The inner pipe section 101*d* is seal welded to the outer pipe of the exhaust branch pipe 10*b* at the inlet flange 12*b*, and the inner pipe section 101*e* is supported by a sliding support 201*c* at the inlet of the bellows 201. The sliding support 201*c* has a similar construction as the sliding support 210*a*. At the outlet of the bellows 201, the inner pipe and the outer pipe of the double walled exhaust pipe 10*c* are seal welded to each other.

In this embodiment, since the configuration of the exhaust pipe 10 is very complicated, the direction of the thermal expansion of the pipes are three-dimensional. Therefore, the bellows 200 and 201 are required to absorb the thermal expansion in directions perpendicular to the axis of the pipes.

A sliding connection 220 which has similar construction as the sliding connection 22 in FIG. 2 is disposed at the portion upstream of the bent portion 115*b* having a larger bending angle. When more than one bent portions are provided, the thermal expansion of the inner pipe section usually causes the inner pipe to contact the outer pipe at the bent portion having the largest bending angle.

Therefore, the sliding connection between the inner pipe sections must be provided at the portion between the exhaust inlet portion (at which the inner pipe is fixed to the outer pipe) and the bent portion having the largest bending angle to avoid the thermal expansion of the inner pipe from effecting the bent portion. Also, it is preferable to dispose the sliding connection in the proximity of the bent portion having the largest bending angle in order that all of the thermal expansion upstream of the bent portion is effectively absorbed by the sliding connection.

Therefore, as shown in FIG. 8, the sliding connection 220 in this embodiment is disposed between the bent portion 115*b* having the largest bending angle and the bent portion 115*a* having a smaller bending angle, i.e., the sliding connection 220 is disposed at the portion directly upstream of the bent portion 115*b*.

According to the embodiment in FIGS. 7 and 8, the thermal expansion of the exhaust pipe having a complicated configuration can be absorbed by the combination of the bellows 200, 201 and the sliding connection 220.

Though the present invention has been described with reference to specific embodiments selected for the purpose of illustration, it should be understood that numerous modifications could be applied by those skilled in the art without departing from the basic concept and scope of the present invention.

For example, although not indicated in the above embodiments, sliding supports of similar construction as the support 26 in FIG. 2 may be provided between the outer pipes and the inner pipes near the respective sliding connections to ensure a positive radial support for the inner pipe while permitting the longitudinal movement of the inner pipe.

We claim:

1. A double walled exhaust pipe having an outer wall and an inner wall spaced apart by a radial clearance therebetween, with an exhaust gas inlet portion at one end of the double walled exhaust pipe and an exhaust gas outlet portion at the other end of the double walled exhaust pipe, the double walled exhaust pipe comprising:

an outer pipe, wherein the wall of the outer pipe forms the outer wall of the double walled exhaust pipe;

an inner pipe which is coaxially disposed within the outer pipe, wherein the wall of the inner pipe forms the inner wall of the double walled exhaust pipe;

a plurality of bent portions including a first bent portion and at least one second bent portion, wherein in the first bent portion the double walled exhaust pipe is bent through a first bending angle and in said second bent portion the double walled exhaust pipe is bent through a second bending angle and wherein the first bending angle is larger than said second bending angle and wherein the outer pipe is rigid and is one-piece from the exhaust inlet portion to at least the first bent portion;

wherein, said inner pipe comprises a plurality of longitudinal sections connected to each other by at least one sliding connection which allows relative longitudinal movement between the sections, and wherein the sliding connection is disposed within a portion of the inner pipe between the exhaust gas inlet portion and the first bent portion.

2. A double walled exhaust pipe according to claim 1, wherein the inner pipe and the outer pipe are substantially straight at the portion between the exhaust gas inlet portion and the first bent portion.

3. A double walled exhaust pipe according to claim 1, wherein the inner pipe and the outer pipe are substantially straight at the portion between the exhaust gas outlet portion and the first bent portion.

4. A double walled exhaust pipe according to claim 3, wherein the sliding connection is disposed between the first bent portion and the second bent portion.

5. A double walled exhaust pipe according to claim 1, wherein another of the at least one sliding connection is disposed within a portion of the inner pipe between the first bent portion and the exhaust gas outlet portion.

* * * * *